United States Patent [19]

Snyder

[11] 4,348,828

[45] Sep. 14, 1982

[54] LASER-AIMING SYSTEM WITH MEANS FOR ELECTRICAL ARC SUPPRESSION

[76] Inventor: Wesley L. Snyder, 1103 Forest Home Dr., Houston, Tex. 77077

[21] Appl. No.: 77,990

[22] Filed: Sep. 24, 1979

[51] Int. Cl.[3] ..... F41G 1/34

[52] U.S. Cl. ..... 42/1 A

[58] Field of Search ..... 42/1 A

[56] References Cited

U.S. PATENT DOCUMENTS

| | | | |
|---|---|---|---|
| 1,452,651 | 4/1923 | Norrlin | 42/1 A |
| 1,535,459 | 4/1925 | Frederickson | 42/1 A |
| 2,510,289 | 6/1950 | Livermore | 42/1 ST |
| 2,597,466 | 5/1952 | Felix | 42/1 ST |
| 2,715,275 | 8/1955 | Kipp | 42/1 ST |
| 2,844,710 | 7/1958 | Zinsser | 42/1 A |
| 3,153,856 | 10/1964 | Felix | 42/1 ST |
| 3,471,932 | 10/1969 | Luning | 42/1 ST |
| 3,867,764 | 2/1975 | Dunmire et al. | 42/1 A |
| 4,026,054 | 5/1977 | Snyder | 42/1 A |
| 4,048,489 | 9/1977 | Giannetti | 42/1 A |
| 4,079,534 | 3/1978 | Snyder | 42/1 A |
| 4,152,754 | 5/1979 | de Filippis et al. | 42/1 A |
| 4,161,076 | 7/1979 | Snyder | 42/1 A |
| 4,161,835 | 7/1979 | Lough | 42/1 A |
| 4,168,588 | 9/1979 | Snyder | 42/1 A |

FOREIGN PATENT DOCUMENTS

| | | | |
|---|---|---|---|
| 804175 | 7/1936 | France | 42/1 A |
| 401410 | 1/1943 | Italy | 42/1 A |

OTHER PUBLICATIONS

*Standard Handbook for Electrical Engineers,* pp. 404–407, (1941).

"Scope Your Handgun for Higher Scores", *The American Rifleman,* William F. Krentz, pp. 34–35, Jun. 1974.

*Guns,* The American 180–New .22 SMG, Clair Rees, pp. 45–47, Dec. 1973.

"Laser Aimed Weapons", Newport Research Brochure.

*Primary Examiner*—Charles T. Jordan

*Attorney, Agent, or Firm*—Arnold, White & Durkee

[57] ABSTRACT

Disclosed is a laser-aiming system having a means for suppressing electrical arcing and corona. The aiming system includes a light source, a member for supporting the light source having fill ports with valving mechanisms, and a buffer system for protecting the light source upon recoil of the weapon. The fill port valve connection to the member enables the evacuation of mositure and gas from within the member and further enables the introduction of dry gas or liquid for providing a stabilizing atmosphere around the light source for electrical arc suppression. The dry gas may be a dry inert gas such as nitrogen, for example, and the liquid may be ethylene glycol, for example.

33 Claims, 2 Drawing Figures

LASER-AIMING SYSTEM WITH MEANS FOR ELECTRICAL ARC SUPPRESSION

BACKGROUND OF THE INVENTION

This invention relates to a laser-aiming device for weapons, and more specifically to a laser-aiming device having an electrical arc and corona suppressor.

The art for laser-aiming systems has steadily progressed from a primitive mounting of a laser tube, or other collimated light source, onto a weapon to a sophisticated means of mounting a collimated light source having buffering capability and interchangeability with different weapons. A detailed accounting of the development of the laser-aiming art may be found in U.S. Pat. Nos. 4,026,054, 4,079,534 and 4,161,076 wherein the laser art is developed from external mounting with external buffering to sophisticated mountings within a dustproof housing. All of these are patents of the inventor of the present invention.

The advantages provided by a lasing system, especially at night, are well acknowledged. The need has developed for accurate aiming with a completely self-contained system able to operate effectively under severe environmental conditions as well as to withstand recoil shock from the weapon itself. The use of the weapon requires the aiming device to be exposed to severe weather, high altitudes, dust, water and other type of contaminants on or around the aiming system. Such contaminants often prevent proper functioning of the aiming device at very critical times. U.S. Pat. No. 4,161,076 discloses a laser-aiming system having a laser tube enclosed in a dust-proof housing where buffering means are present for preventing shock upon recoil of the weapon. This enclosed system is one of the later developments in the laser-aiming art, and although solving many of the problems of removing contaminants from around the aiming system, it has created problems in electrical arcing and corona within the housing.

The laser enclosure, or housing, supporting the plasma tube will normally have a buffering mechanism for protecting the laser tube upon recoil of the weapon. The housing may also have a lateral shock absorber. The system with the lateral shock absorber may also include a metal sheath for immediately surrounding the plasma tube and absorbant material.

Electrically the laser system has an electrical potential going through the laser tube with the housing acting as cathode or ground. An often encountered problem is electrical arcing or corona that is present between the plasma tube and the housing or sheath penetrating the urythane foam. This arcing is found to be the result of humidity and rarified gases, found at high altitudes, that are present in the housing. Thus, although the housing is dust-proof and waterproof there is still a certain amount of humidity and rarified gases that may be found within the housing causing arcing and corona problems.

As a result of this arcing, which essentially removes the plasma tube from the electrical circuit defined by the power supply as the high or positive side, and the housing as the ground or low side, a serious current drain is placed on the power supply. This detrimentally effects the power supply, and may further destroy any diodes or transistors in the system or the batteries themselves in the power supply.

Secondary results are burning wires connecting the power supply and the plasma tube and smoke resulting from the electrical arc, placing residue on the optics of the system. Arcing further depletes the insulating gases in the air and contributes to instability of atmosphere, thus causing a more direct path from the high voltage side of the electrical circuit to the ground through the air and not through the plasma tube. Once arcing begins it will normally continue and deteriorate the overall system.

SUMMARY OF THE INVENTION

In accordance with the present invention, a laser-aiming system is provided having a light source, a member for supporting that light source, and a buffer. The member is further provided with at least one fill port for enabling the evacuation of all moisture and gas from the member and for enabling the introduction of a fluid chemical composition into the member for purposes of arc and corona suppression.

In one embodiment of the present invention a laser-aiming system is provided wherein a housing supporting the laser tube has one fill port for accepting a valve mechanism that enables the introduction of the fluid chemical composition into the interchamber defined by the housing. The housing may become pressurized by introducing a dry inert gas, such as nitrogen, for example. Arc suppression may also be obtained by introducing an insulating liquid into the housing. In both instances, the electrical arc and corona will be suppressed in the electrical system, and as a secondary advantage there will be a reduction in escape of the neon-helium mixture of the laser tube into the outside atmosphere of the housing. This retardation of escape of neon-helium will enhance the longevity of the laser tube, and thus the efficiency and longevity of the laser-aiming system.

In an alternative embodiment, the member or housing may have front and rear end caps. These end caps have a sealant or seals for making the housing dust-proof and waterproof. The rear or front end cap may further be provided with a fill port adapted to receive an arc suppressor for introducing the fluid chemical composition for providing arc suppression and prevention of loss of the neon-helium mixture to the laser tube, as described above.

A further embodiment of the present invention involves a housing or member with two fill ports, adapted to receive two valves mechanisms. The first valve mechanism would be utilized for evacuation of the innerchamber of the housing, while the second valve mechanism would be utilized for introducing a fluid chemical composition as described above.

A method for suppressing electrical arc and corona is also disclosed, wherein the method includes the steps of evacuating the innerchamber defined by the housing, and the further step of introducing a fluid chemical composition into the housing by way of a valve mechanism through a fill port. The step of evacuating the air and moisture from the innerchamber may be accomplished either by a vacuum system or a system of oven-baking the device. The fluid chemical compositions may be any dry inert gas such as nitrogen, or insulating liquids.

BRIEF DESCRIPTION OF THE DRAWINGS

A more complete appreciation of the invention may be had by reference to the accompanying drawings, illustrating embodiments of the invention to be described in detail hereinbelow. The same reference numerals designate identical or corresponding parts throughout the several views wherein.

DETAILED DESCRIPTION OF THE DRAWINGS

Figure 1:
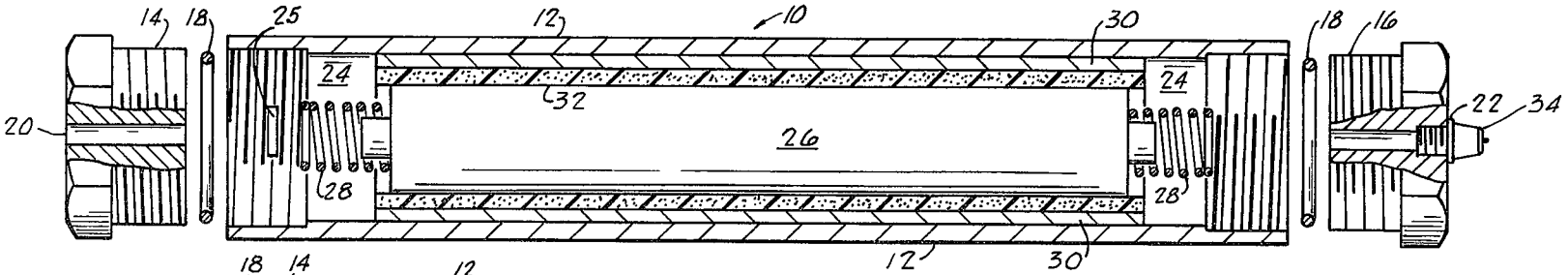
FIG. 1 is a side view of a laser-aiming system that may be mounted on a weapon having an elongate barrel, where the support member has one fill port with a single valve mechanism.

Referring now to FIG. 1, a laser-aiming system 10 is illustrated. Laser-aiming system 10 comprises an outer tubing 12 made of a metal material which when enclosed forms a dustproof housing.

The outer tubing 12 may be complimented by front and rear housing caps 14 and 16 respectively, to form the enclosure for the optics of the laser-aiming system 10. The front and rear caps may be screw-threaded for compression-like fitting into the chamber defined by the outer tubing 12. In order to make the final enclosure dustproof and waterproof a sealant or seal 18 is provided between the front and rear housing caps 14 and 16. The sealant may be in the form of a rubber "O"-ring or any other type of liquid or chemical seal such as epoxy, for example.

The front housing cap 14 is provided with an aperture 20 for emitting the collimated light from the optics of the laser-aiming system 10. The rear housing cap 16 is also be provided with an aperture or fill port 22 that enables the evacuation of all moisture and air from the internal chamber defined by the outer tubing 12, and the introduction of a fluid chemical composition for arc suppression into the internal chamber 24.

The optics of the laser-aiming system 10 is a collimated light source 26 in the form of a laser tube or plasma tube. This laser tube is electrically connected to a power source and other circuitry for switching the laser tube 26 into an active or on state. The power supply and peripheral circuitry for the light source 26 is not shown in the drawings.

In order to prevent breakage and undue shock to the light source 26 buffering mechanisms are provided within the inner chamber defined by the outer tubing 12 and the front and rear housing caps 14 and 16. Buffers 28 are provided for absorbing vertical shock of the laser-aiming system 10. These buffers may be in form of springs or other damping mechanism. In order to protect the light source 26 from lateral shock a sheath 30 is provided for encapsulating the light source 26 in a bed of foam material 32. This foam may be a standard packing foam material such as polyurethane, for example.

During normal operation of the laser-aiming system 10, the light source 26 will electrically be included in and a main part of the total system circuit, where the voltage potential will be directed across the light source 26 for projecting a laser beam through the aperture 20 in front housing cap 14. However, the internal chamber defined by tube 12 although waterproof and dustproof, as a result of the enclosure from front and rear housing caps 14 and 16, still has a significant amount of humidity within the internal chamber 24 and further at high altitudes has a certain amount of rarified gases. These atmospheric conditions cause electrical arcing and corona of the light source 26. With this electrical arcing the light source is essentially removed from the electrical circuit and an electrical arc is generated between the positive potential of the power source, or any other positive electrical potential within the internal chamber 24, and the sheath 30, or outer tube 12, which act as a negative potential or ground. This arcing provides a drain on the power supply for the light source 26, and further may cause other detrimental effects to the laser-aiming system 10 as burning wires, destroying diodes and transistors, and fogging the optics and lenses of the system by smoke and residue resulting from the arcing.

The unwanted humidity and rarified gases may be exhausted from the inner chamber 24 of the housing defined by the tubing 12 and front and rear housing caps 14 and 16 through aperture 22 in rear housing cap 16. This evacuation may be effected by oven-baking the entire device 10, or by a vacuum system attached through the fill port or aperture 22 in rear housing cap 16.

After the unwanted liquids and gases have been removed from the chamber 24 a fluid chemical composition may be introduced into the chamber 24 through the fill port 22 by way of a valving mechanism 34. The valve mecanism 34 may be a standard valving device such as a tire valve core stem, for example.

The fluid chemical composition introduced into the inner chamber 24 is in the form of a dry inert gas or liquid. The dry inert gas may be nitrogen, for example, while the liquid may be ethylene glycol or a liquid silicon.

In both instances, that is whether a dry inert gas or liquid is introduced into the chamber, the atmosphere surrounding the light source 26 will be substantially stabilized inhibiting any electrical arcing, and in fact increasing the electrical resistance around the light source 26 thus enhancing and maintaining the electrical path from the power source through the laser tube 26. Thus, the fluid chemical composition whether in the form of a dry inert gas or a liquid enhances the electrical insulation between the anode of the plasma tube 26 and the housing defined by the tube 12 or in the alternative the sheath 30.

Figure 1A:
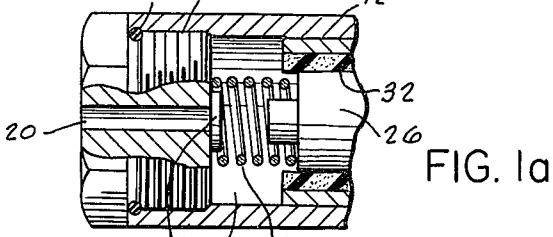
FIG. 1A is a partial view of the front end of the laser-aiming system in an assembled view; and, FIG. 2 is a side view of a laser-aiming system wherein the support member has two valve mechanisms for introduction of a fluid chemical composition into the inner chamber of the member in accordance with the present invention.

FIG. 1A illustrates an assembled view of the front end of the laser-aiming system 10. The lens 25 illustrated in FIG. 1 is detailed in FIG. 1A as sealably connected to the front end cap 14 in such a manner to assure housing of being dustproof and waterproof. The lens 25 enables the projection of the laser beam through the aperture 20 while retaining a closed internal chamber defined by the tube 12. Besides enclosing the internal chamber to be waterproof and dustproof in accordance with the present invention, the electrical arc suppressor is accordingly retained in the internal chamber with the front end cap 14, lens 25 and rear cap 16 sealing the tube 12.

There are many secondary advantages in the use of the dry inert gas or liquid compositions for electrical arc and corona suppression. Using a liquid, for example, further enhances the shock damping in the overall laser-aiming system 10. Also, using the liquid or dry inert gas retards the migration of the neon-helium mixture found in the laser tube 26 through its glass skin. This retardation increases the longevity of the light source 26 and thus the overall effectiveness and logevity of the laser-aiming system 10. It is noted that this method of pressurizing the light source 26 is distinguished from hermetically sealing the device, which evacuates all atmosphere and gases from the internal housing 24 and enhances the migration of the neon-helium mixture through the glass skin of any light source.

Figure 2:
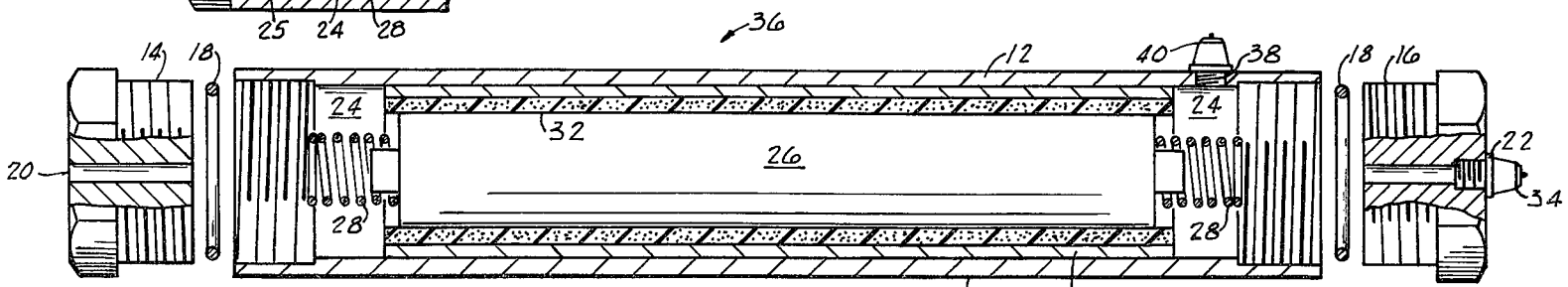

Referring now to FIG. 2, a laser-aiming system 36 is illustrated which is substantially the same as laser-aiming system 10 in FIG. 1 except for the addition of a second fill port 38. The second fill port 38 is located in the tubing 12 through to the inner chamber 24. A second valve mechanism 40 identical to the valve mechanism 34 described with respect to FIG. 1 is attached to the laser-aiming system 36 through fill port 40 so as to access the inner chamber 24.

Operationally, laser-aiming system 36 is identical to the laser-aiming system 10 described in FIG. 1. The method and apparatus for suppressing electrical arc and corona differ from the laser-aiming system 10 in FIG. 1 in the use of the two valve mechanisms 34 and 40. In effect, the provision for two valve mechanisms enables the evacuation of air and moisture through fill port 38 and out valve mechanism 40 and the introduction of the fluid chemical composition through valve 34 and fill port 22. It is noted that these operations may occur simultaneously, that is, the chemical composition, in the form of a dry inert gas or liquid may be introduced to the inner chamber 24 and this in turn would evacuate the atmospheric gases and humidity from the inner chamber 24 through fill port 38 and out valve mechanism 40 placed in an open position. Alternatively, the operation may be done in a two steps, where evacuation of the inner chamber 24 is accomplished through either of fill ports 22 or 38 with the introduction of the chemical composition through the other fill port. The end result in both instances is the pressurization of the light source 26 by a dry inert gas or liquid thus suppressing the electrical arc and corona induced by the moisture and rarified gases in the atmosphere surrounding the laser tube before evacuation.

The housing defined by outer tube 12 and front and rear housing caps 14 and 16 as shown in FIG. 1 may be pressurized with a fluid chemical composition during the initial manufacturing process of the laser aiming system 10. Since there is also the need to replace old laser tubes in the system, the housing will also need maintenance. Thus, the method of the present invention further includes the step of repressurizing the inner chamber of the housing for the laser tube after normal maintenance of the laser system 10.

While the present invention has been described in relation to specific embodiments, and methods, it should be apparent to those skilled in the art that various modifications may be made without departing from the spirit and scope of the invention.

What is claimed is:

1. An aiming system for weapons comprising:

a light source for projecting a coherent beam of light onto a target to mark the impact point of a projectile from said weapon, said light source electrically operated by a high frequency, high voltage power source;

a member supporting said light source attached to said weapon, whereby said light source being susceptible of producing electrical arcing and corona between said power supply and said member;

an electrical arc suppressor disposed between said member and said light source for eliminating electrical arc and corona between said member and said power supply; and a buffer disposed within said member for absorbing shock to said light source upon recoil of said weapon.

2. An aiming system as set forth in claim 1 wherein said electrical arc suppressor comprises a fluid chemical composition.

3. An aiming system as set forth in claim 2 wherein said fluid chemical composition is a dry inert gas.

4. An aiming system as set forth in claim 3 wherein said dry inert gas is nitrogen.

5. An aiming system as set forth in claim 2 wherein said fluid chemical composition is a liquid.

6. An aiming system as set forth in claim 5 wherein said liquid is ethylene glycol.

7. An aiming system as set forth in claim 1 wherein said member has at least one fill port adapted for receiving said electrical arc suppressor.

8. An aiming system as set forth in claim 7 wherein said member further includes a valve connected to at least one fill port, wherein said valve provides a means for evacuating said member of all gasses and liquid, and also provides a means for introducing said electrical arc suppressor.

9. An aiming system as set forth in claim 1 wherein said light source is a plasma tube.

10. An aiming system as set forth in claim 1 wherein said buffer includes a lateral shock absorber comprising of a foam material.

11. An aiming system for weapons comprising:

a light source for projecting a coherent beam of light onto a target to mark the impact point of a projectile from said weapon, said light source electrically operated by a high frequency, high voltage power source;

a member supporting said light source attached to said weapon having at least one fill port adapted to receive an arc suppressing fluid;

an electrical arc suppressor disposed between said member and said light source for eliminating electrical arc and corona between said member and said power supply; and a buffer disposed within said member for absorbing shock to said light source upon recoil of said weapon.

12. An aiming system as set forth in claim 11 further including a valve mechanism connected to said fill port for providing a means for introducing said electrical arc suppressor.

13. An aiming system as set forth in claim 11 wherein said member has two fill ports, a first fill port for evacuating said member of all gas and liquid, and a second fill port for introducing a fluid chemical composition into said member for electrical arc suppression.

14. An aiming system for weapons comprising:

an electrically operated light source for producing a beam of light for marking the destination of a projectile from said weapon, said light source being susceptible of producing electrical arc and corona;

a member pressurized with an arc suppressing fluid and which is attached to said weapon for supporting said light source;

said member comprising a cylindrical housing having first and second means for enclosing said housing at each end thereof, and means for pressurizing said housing with said arc suppressing fluid connected to one of said first and second means; and a buffer disposed within said member for absorbing shock to said light source upon recoil of said weapon.

15. An aiming system as set forth in claim 14 wherein said first means comprises a front housing cap having an aperture therein, said front housing cap connected to a optical window for projecting light from said light source through said aperture, and a sealant disposed between said front housing cap and said housing for pressure sealing said housing; and, said second means comprising a rear housing cap having a fill port for accepting said means for pressurizing said housing, and, a sealant disposed between said rear housing cap and said housing for pressure sealing said housing.

16. An aiming system as set forth in claim 14 wherein said means for pressurizing said housing comprises a valve mechanism.

17. An aiming system as set forth in claim 15 wherein said front and rear housing caps are screw-threaded caps enabling compression and pressure sealing of said housing by tightening said caps against said sealant.

18. An aiming system as set forth in claim 15 wherein said sealant is an "O" ring.

19. A method of suppressing electrical arc and corona in a laser aiming system for weapons having a member for supporting a light source attached to said weapon, comprising the steps of:

evacuating said member of all moisture and air; and, introducing into said member a chemical composition providing a stabilized atmosphere surrounding said light source, increasing the electrical resistance and maintaining an electrical path between the positive and negative terminals of electrical circuit means within said member.

20. The method of suppressing electrical arc and corona as set forth in claim 19 wherein said step of evacuating said member of moisture and air includes oven-baking said aiming system.

21. The method of suppressing electrical arc and corona as set forth in claim 19 wherein said step of evacuating said member of all moisture and air includes evacuation by a vacuum system.

22. The method of suppressing electrical arc and corona as set forth in claim 19 wherein said chemical composition is a dry inert gas.

23. The method of suppressing electrical arc and corona as set forth in claim 19 wherein said chemical composition is an insulating liquid.

24. A method of suppressing electrical arc and corona in a laser aiming system for weapons having a member for supporting a light source that identifies target location; comprising the steps of:

evacuating said member of all moisture and air;

pressurizing said member by introducing a chemical composition providing a stabilized atmosphere for surrounding said light source, increasing the electrical resistance and maintaining an electrical path between the positive and negative terminals of electrical circuit means within said member; and repressurizing said member after maintenance of said light source with said member.

25. An aiming system for weapons comprising:

a light source for projecting a coherent beam of light onto a target to mark the impact point of a projectile from said weapon, said light source electrically operated by a high frequency, high voltage power source;

a member supporting said light source attached to said weapon, whereby said light source being susceptible of producing electrical arcing corona between said power supply and said member; and an electrical arc suppressor disposed between said member and said light source for eliminating electrical arc and corona between said member and said power supply.

26. An aiming system for weapons comprising:

a light source for projecting a coherent beam of light onto a target to mark the impact point of a projectile from said weapon, said light source electrically operated by a high frequency, high voltage power source;

a member secured to the weapon for carrying the light source such that the beam is directed along the barrel of the weapon, said member defining an internal surface;

an electrical arc suppressor interposed between said light source and said internal surface; and an electrical arc suppressor disposed between said member and said light source for eliminating electrical arc and corona between said member and said power supply.

27. An aiming system for weapons comprising:

an electrically operated light source for producing a beam of light for marking the destination of a projectile from said weapon, said light source being susceptible of producing electrical arcs;

a member supporting said light source attached to said weapon, having an electrical arc suppressor within said member, wherein said electrical arc suppressor comprises a dry inert gas; and a buffer disposed within said member for absorbing shock to said light source upon recoil of said weapon.

28. An aiming system as set forth in claim 27 wherein said dry inert gas is nitrogen.

29. An aiming system for weapons comprising:

an electrically operated light source for producing a beam of light for marking the destination of a projectile from said weapon, said light source being susceptible of producing electrical arcs;

a member supporting said light source attached to said weapon, having an electrical arc suppressor within said member, wherein said electrical arc suppressor comprises a liquid chemical composition; and a buffer disposed within said member for absorbing shock to said light source upon recoil of said weapon.

30. An aiming system as set forth in claim 29 wherein said liquid is ethylene glycol.

31. An aiming system for weapons comprising:

an electrically operated light source for producing a beam of light for marking the destination of a projectile from said weapon, said light source being susceptible of producing electrical arc;

a member supporting said light source attached to said weapon, having an electrical arc suppressor within said member, wherein said member has at least one fill port adapted for receiving said electrical arc suppressor and further includes a valve connected to at least one said fill port where said valve provides a means for evacuating said member of all gasses and liquid, and also provides a means for introducing said electrical arc suppressor; and a buffer disposed within said member for absorbing shock to said light source upon recoil of said weapon.

32. An aiming system for weapons comprising:

an electrically operated light source for producing a beam of light for marking the destination of a projectile from said weapon, said light source being susceptible of producing electrical arcs;

a member supporting said light source attached to said weapon, having at least one fill port adapted to receive an arc suppressing fluid, and further including a valve mechanism connected to said fill port for providing a means for introducing said electrical arc suppressor; and a buffer disposed within said member for absorbing shock to said light source upon recoil of said weapon.

33. An aiming system as set forth in claim 32 wherein said member has two fill ports, a first fill port for evacuating said member of all gas and liquid, and a second fill port for introducing a fluid chemical composition into said member for electrical arc suppression.

* * * * *